US007172337B2

(12) United States Patent
Roszczenko et al.

(10) Patent No.: US 7,172,337 B2
(45) Date of Patent: Feb. 6, 2007

(54) LOW SHEAR IMPELLER

(75) Inventors: Janusz Roszczenko, Harrisburg, PA (US); Wojciech Wyczalkowski, Swatara, PA (US)

(73) Assignee: Philadelphia Mixing Solutions, a division of Philadelphia Gear Corporation, Palmyra, PA (US)

( * ) Notice: Subject to any disclaimer, the term of this patent is extended or adjusted under 35 U.S.C. 154(b) by 436 days.

(21) Appl. No.: 10/885,401

(22) Filed: Jul. 6, 2004

(65) Prior Publication Data

US 2005/0007874 A1 Jan. 13, 2005

Related U.S. Application Data

(60) Provisional application No. 60/485,585, filed on Jul. 8, 2003.

(51) Int. Cl.
*B01F 7/20* (2006.01)

(52) U.S. Cl. ..... 366/270; 366/307; 366/327.3; 366/330.3

(58) Field of Classification Search ..... 366/64–66, 366/270, 307, 325.92, 325.93, 327.1, 327.3, 366/330.1, 330.3; 416/237; 261/84, 91; 422/224–228

See application file for complete search history.

(56) References Cited

U.S. PATENT DOCUMENTS 2,074,387 A * 3/1937 Gill ..... 416/237
3,149,888 A * 9/1964 Lennon ..... 366/330.1
5,253,980 A * 10/1993 Nishioka et al. ..... 416/227 R
5,399,014 A 3/1995 Takata et al.
5,472,278 A * 12/1995 Kawaoka et al. ..... 366/307
5,762,417 A * 6/1998 Essen et al. ..... 366/270
6,331,071 B2 12/2001 Akamikne et al.
6,508,583 B1 1/2003 Shankwitz et al.
2003/0007417 A1* 1/2003 Miyata et al. ..... 366/325.92
2005/0007874 A1* 1/2005 Roszczenko et al. .... 366/330.3

FOREIGN PATENT DOCUMENTS

DE 3817380 A1 * 12/1988
JP 5-103965 * 4/1993

* cited by examiner

*Primary Examiner*—Charles E. Cooley
(74) *Attorney, Agent, or Firm*—Duane Morris LLP

(57) ABSTRACT

One or more mixing impellers is carried on a driving shaft received in a mixing vessel. Impeller blades are angularly and/or axially distributed on the shaft and can be single staggered axially-spaced blades or groups of two or more placed angularly around the shaft, e.g., diametrically opposite. Each blade has a radially inner flat plate sloped to produce axial flow, preferably at about 15° from parallel to the rotation axis. An outer plate is joined to the inner plate at a bend line with an angle of about 20° located at about 70% of the outside diameter of the impeller path.

19 Claims, 7 Drawing Sheets

LOW SHEAR IMPELLER

CROSS REFERENCE TO RELATED APPLICATION

This application claims the priority of U.S. Provisional Application Ser. No. 60/485,585, filed Jul. 8, 2003.

BACKGROUND OF THE INVENTION

1. Field of the Invention

The invention relates to mixing apparatus for producing blends of liquids, solids suspensions, and gas dispersions, at low and controllable shear.

2. Prior Art

Various different types of impellers are used for different mixing applications. Among other purposes, mixing may involve any of various procedures in which agitation, flow or other movement is produced in a material, and an impeller affects the movement. Typically the impeller is moved relative to a vessel containing the liquids or solids to be mixed, but that is just one possible configuration.

Mixing often is used in an effort to achieve uniformity of blend or solids suspension, crystallization and dispersion of immiscible fluids or gases, etc., and this disclosure, without limitation, generally refers to examples in which such mixing is involved.

The degree of mixing obtained over a given mixing duration, and/or the duration of mixing needed to achieve a given degree of mixing, depends in part upon the rate at which mechanical energy is transferred from the impeller to the fluid. Transfer of energy can be a complex process, and takes place throughout the entire mixing domain. The intensity of energy dissipated locally within a vessel varies with location. A high proportion of energy dissipation occurs in the impeller zone, where a total of 20% to 25% of the energy supplied in generating relative movement of the impeller is dissipated in the impeller swapped volume. The swapped volume is the volume where the moving impeller blades encounter product on a leading side of the blades, displace the product, and where other product fills in on the trailing side of the blades.

Products containing delicate particle agglomerates, polymers such as latex, living organisms and other such products, can be damaged by high levels of shear. High shear results from vigorous mixing characterized by a high rate of dissipation of energy into the product. Inasmuch as the transfer of energy is most concentrated in the impeller zone, it would be advantageous when mixing such products to reduce local shear at the impeller to a minimum. Reducing shear reduces the transfer and dissipation of energy into the local impeller zone.

One way to decrease local energy dissipation at an impeller is to increase the projected height or axial extension of the impeller blades. This increases the volume of product that is encountered by the impeller blades and "swapped" as the impeller passes during each impeller rotation. Assuming equal process power is applied to a rotating impeller shaft (i.e., equal torque and rate of rotation), changing to an axially longer impeller will spread the same energy over a larger swapped volume. That reduces local dissipation because the dissipation is less concentrated.

Increasing the swapped volume by increasing the radial dimension of the blades also increases the impeller volume and spreads the energy over a larger volume. However, the radially outer part of an impeller has a higher linear speed if the radius is made longer, which is a factor that increases local shear at the radially outer parts of the impeller blade.

Although dissipated energy from an axially extended larger impeller is spread over a larger swapped volume, the apparatus can still be effective for mixing. The larger impeller affects a larger local impeller zone, and the overall batch may still be well mixed.

The idea of enlarging the size of an impeller blade in this way so as to encounter or swap a larger volume and achieve mixing at less concentrated localized shear can be found, for example, in U.S. Pat. No. 6,508,583 Shankwitz, at al., U.S. Pat. No. 5,399,014 Takata, at al., and U.S. Pat. No. 6,331,071 Akamine, at al.

The foregoing listed patents provide mixing configurations wherein the impeller is characterized by substantially vertical impeller blades, i.e., flat or planar shapes extending radially from and axially along a rotating vertical impeller shaft. This structure produces predominantly a rotational and/or radial flow of product in the impeller zone, and is relatively inefficient for mixing. The movement of the product due to rotation of the impeller is relatively limited to rotating rather than otherwise moving the impeller volume, namely that portion of the product that is in the path of the blades of the rotating impeller. Radial impellers are prone to stratification of the batch in the mixing vessel.

It would be advantageous to provide a configuration in which a low shear impeller is more efficient with respect to its mixing efficiency, without sacrificing the benefits of spreading the dissipation and shear over a large impeller swapping volume.

SUMMARY OF THE INVENTION

Accordingly, an efficient mixing method and apparatus is provided with aspects that produce a good top to bottom axial flow of product and reduces the tendency of a radially protruding and axially extending impeller structure to promote stratification of the batch. The result is a more full and uniform dispersion of phases through the entire mixing vessel, i.e., improved mixing efficiency, in a low shear impeller structure. This and other advantageous results are obtained from structuring the device so as to add an axial component of flow.

According to another inventive aspect, an impeller apparatus and method employ asymmetrical impeller elements and/or placements. Often, an opening into a vessel for passing the impeller shaft (normally an opening at the top of the vessel) defines a dimensional restriction. It is not possible to insert through that restriction an impeller with a larger diameter than the opening. Typically, for example, a 36" diameter vessel may have 6" diameter flange opening at the top. This limits impeller diameter to less than 6". According to the invention, an asymmetric impeller diameter in such a situation may provide an operational impeller volume with a diameter up to 9.5" or more. A larger diameter impeller moves a higher flow at lower local dissipation than a smaller diameter impeller, other thing being equal, by averaging the shaft rotation energy over a larger impeller volume.

The invention encompasses configurations for impellers, impeller blades and vessels for mixing of fluids, with limited and low shear. The impeller blades can be mounted on a vertical rotating shaft that is centered or off center relative to the vessel. The vessel may be equipped with vertical baffles extending inwardly from the inside of the vessel wall toward the impeller, or in other arrangements the vessel can have no baffles. These variations are made depending upon liquid properties and process requirements.

The mixing process can involve a single impeller or multiple impellers. The impeller height or axial extension along the impeller shaft is equal to the cosine of the blade height according to an inclination angle or slope of the blades relative to a plane parallel to the rotation axis (typically from vertical). The slope is an inclined plane that can be placed so as to promote axially upward or downward pumping.

Each impeller or impeller stage can have a single or double blade. Double blade impellers preferably are staggered by 90° to promote mechanical stability. Single blade impellers are staggered by 180° to counterbalance asymmetrical fluid forces and a mixing apparatus with such impellers normally has a minimum of two impellers or stages. Single blade impellers are advantageous for vessels with restricted openings.

These and other objects and aspects of the invention will become apparent in connection with the following description of a representative but nonlimiting set of exemplary embodiments.

BRIEF DESCRIPTION OF THE DRAWINGS

There are shown in the drawings embodiments of the invention as presently preferred for a variety of applications. The invention is applicable as well to other applications and embodiments in addition to those specifically shown in the drawings, wherein.

DETAILED DESCRIPTION

Figure 1:
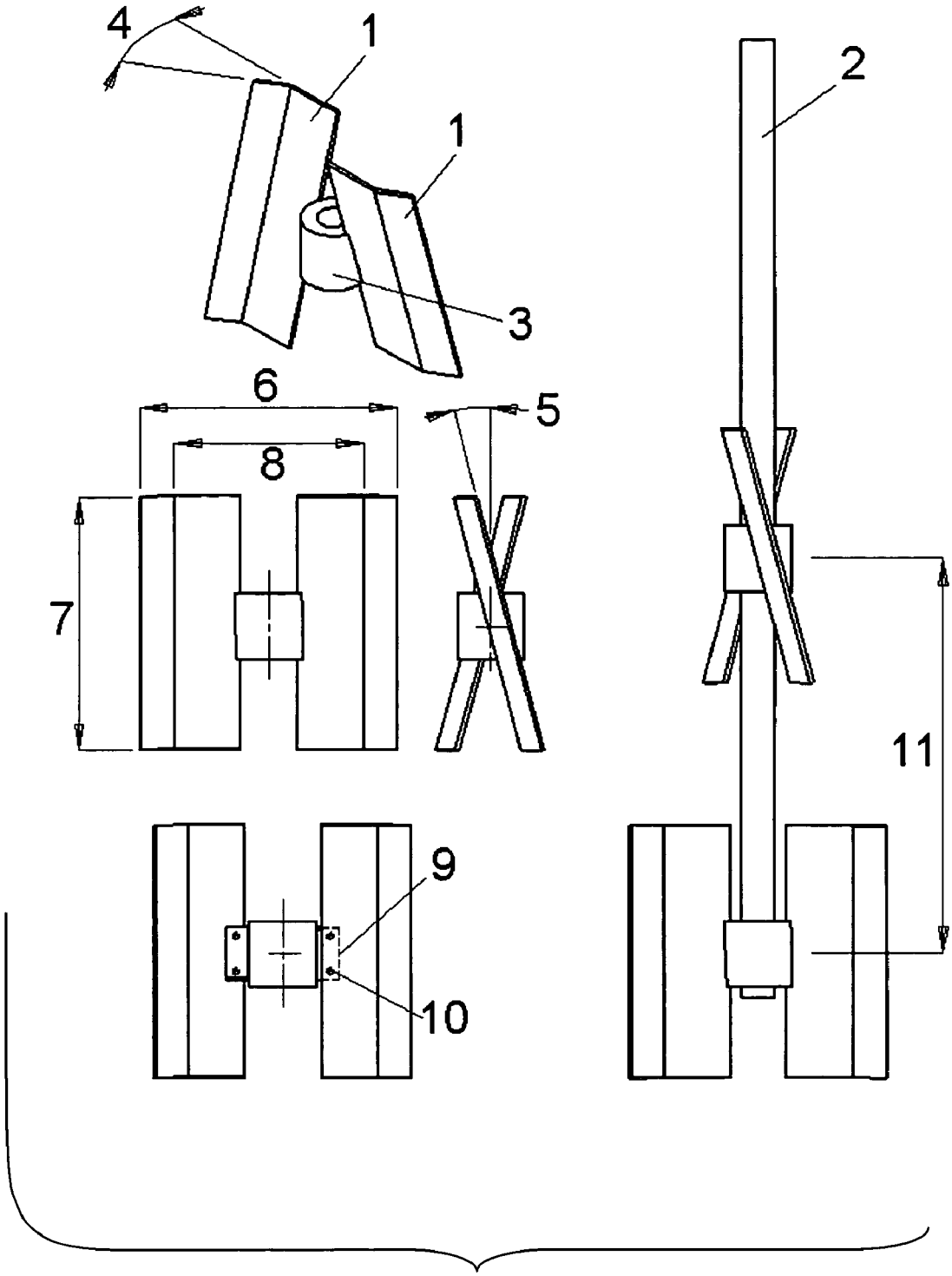
FIG. 1 is a combined perspective and set of elevation views showing a symmetrical impeller or impeller stage, including as mounted in an exemplary arrangement on a rotatable impeller shaft.

This detailed description refers to the embodiments shown in the respective figures and insofar as terms respecting orientations are found in the description (such as vertical, horizontal, above, below, etc.), such terms are intended to refer to the drawing under discussion and do not limit the orientation of the invention. For example, a vertical impeller shaft rotation axis is generally shown throughout the drawings, but it is likewise possible that other orientations could be used where appropriate. Throughout the respective drawing views, the same reference numbers are used where possible to refer to the same or functionally similar elements.

Referring FIG. 1., an advantageous configuration of an impeller comprises two symmetrical blades 1 arranged diametrically opposite one another (offset by 180°) and attached to a rotatable driving shaft 2 by a hub 3. Each blade 1 is bent along a line at the radially outer edge of the blade 1 by an angle 4. This bend at angle 4 helps to reduce local dissipation of energy on the blade edge, where the linear speed of the blade 1 is greater.

In addition, each blade 1 is sloped forward, toward the flow by an angle 5. This angle 5 positions blade 1 to define an inclined plane, which with rotation of shaft 2 induces an axial component of fluid flow. Depending upon the direction of rotation, the axial flow component produced by the inclination angle 5 of blade 1 can be in one axial direction or the other relative to shaft 2, i.e., up or down in FIG. 1.

According to another aspect, the diameter 6 of the impeller stage is made equal to the impeller blade projected height 7, namely the axial extension of blade 1 along shaft 2. This is a proportion of blade projection relative to diameter, and effectively causes the impeller blade 1 to intercept a relatively large volume of product during mixing. As a result, local impeller energy dissipation is substantially reduced relative to conventional arrangements, by distributing the rotational energy applied to shaft 2 over a large volume. As a result, the impeller is advantageous for mixing shear-sensitive fluids and products.

The bend lines to form angle 4 are located on diameter 8 which is particularly located in the range of 70 to 80% of the impeller outside diameter. On the inside edge of blades 1, a secure attachment to hub 3 may be achieved by means of hub ear 9 and bolts 10. Other attachment arrangements are possible such as welding on a surface of hub 3, insertion in a slot (not shown) along hub 3, etc. Plural impellers mounted on shaft 2 are spaced by distance 11, two being shown for example. The number of impellers or impeller stages on shaft 2 is only limited by vessel geometry.

Figure 2:
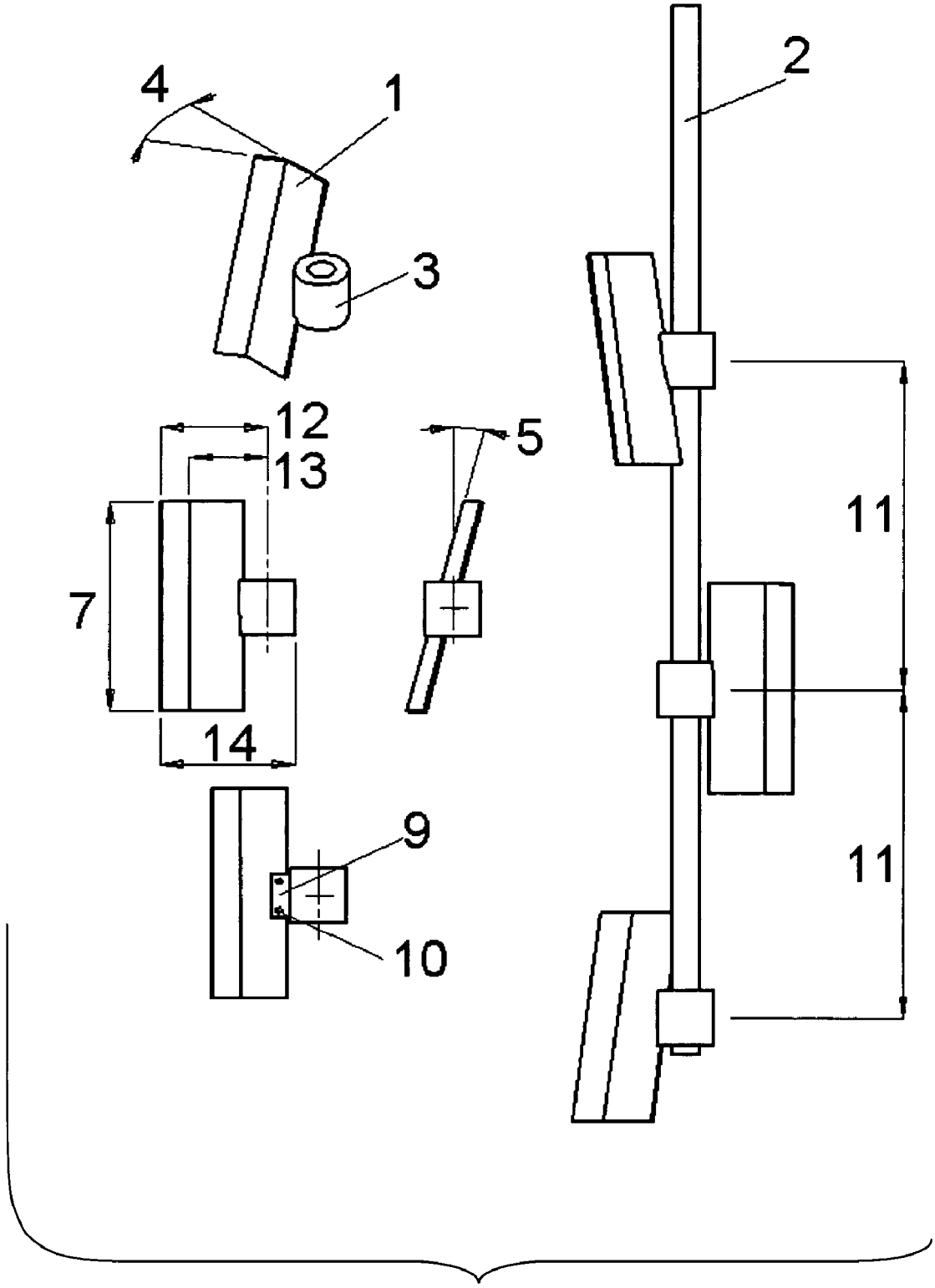
FIG. 2 is a combined perspective and set of elevations the is comparable to FIG. 1 and shows an asymmetrical impeller configuration.

FIG. 2 illustrates an alternative preferred configuration for the impeller wherein the respective stages each comprise a single asymmetrical blade 1, attached to the rotating shaft 2 by hub 3. The blade is likewise bent at an angle 4 on a radially outer edge and in a direction outward of the flow. Each blade also is sloped toward flow as in the previous embodiment by an angle 5. However the blades are arranged at each stage so as to be asymmetrical relative to the rotation axis of shaft 2. In FIG. 2, the blades distributed at different angles around shaft 2, for example being evenly angularly distributed or placed at diametrically opposite positions or otherwise being arranged around the shaft 2.

The radially outer part of the blade, between angle 4 and the free radially outer edge of blade 1, is preferably oriented outward of the flow or on the trailing side of the impeller blade. That is, as the impeller turns, the radially outer part forms a wing that resides angularly behind the part of the blade that is radially nearer to the shaft 2 than angle 4. This eases the shear along the radially outermost edge as compared to a similar arrangement in which the angle 4 is zero. If the configuration shown is operated in the reverse of that rotation direction, the radially outermost edge becomes the leading part of the blade and tends to scoop material in front of the impeller blade, which and is less preferred. In either direction, the impeller blade produces axial flow due to the inclination angle 5.

In the embodiment of FIG. 2, the projected impeller height 7 is equal to two blade radii 12. The blade bend line is located on radius 13. The total blade width 14 spans the blade width and that of the hub 3. Alternative attachment of blades 1 to hub 3 may be achieved by means of hub ear 9 and bolts 10 as already described. Impellers on shaft 2 are spaced by distance 11. The asymmetrical blades shown are oppositely staggered on shaft 2 by 180°. Any number of impellers may be provided along shaft 2, as permitted by the vessel geometry.

Figure 7:
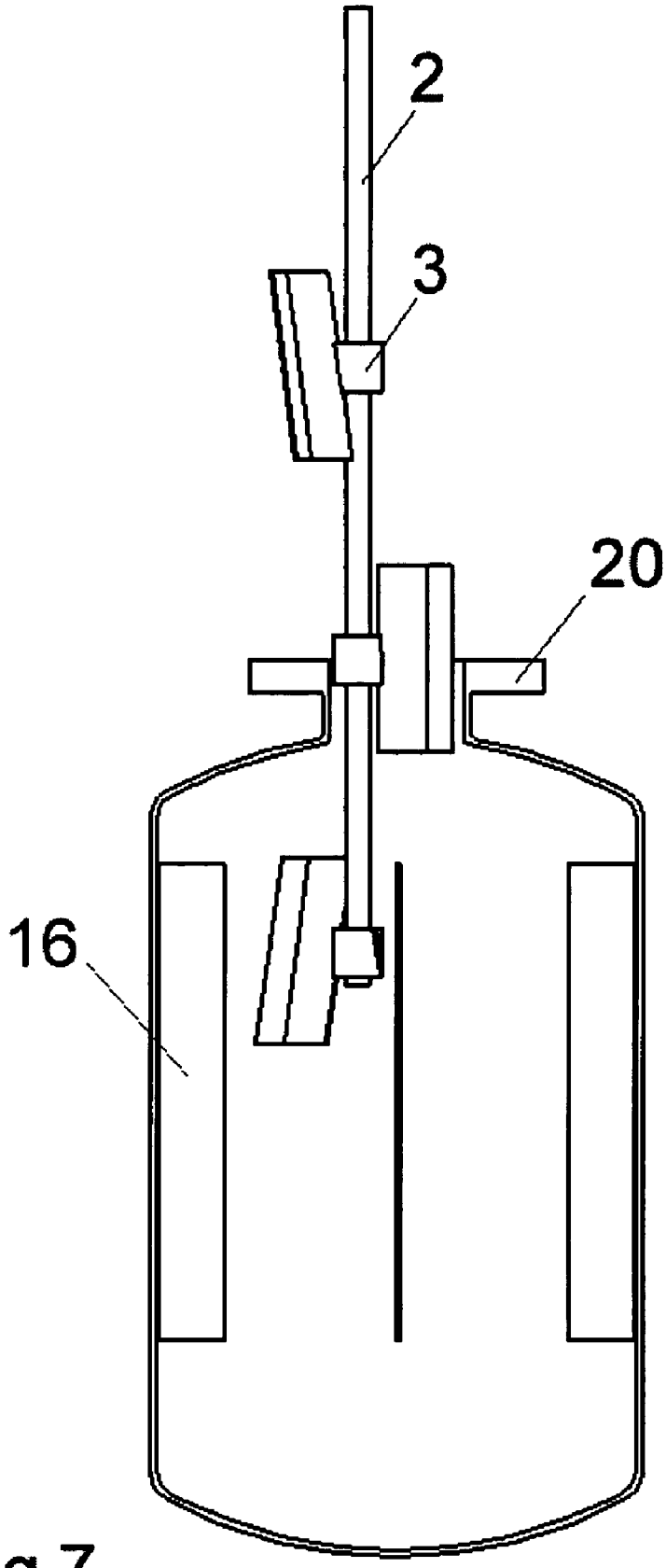
FIG. 7 is a partly sectional elevation view illustration a shaft assembly with asymmetrical impellers, upon insertion or extraction through a vessel flange opening.

The asymmetrical impeller is advantageously employed in a vessel with a limited nozzle size (the nozzle being the entry opening at the flange end of the vessel). As seen in FIG. 7, asymmetrical impellers can be easily inserted to a vessel through a small nozzle opening, namely by laterally displacing the shaft 2 while inserting the impeller arrangement, so as to admit the impeller stages through the opening in turn. Using this technique, the active impeller diameter can be much larger than the opening in the nozzle. This allows mixing fluids without exceeding maximum shear for the process.

Figure 3:
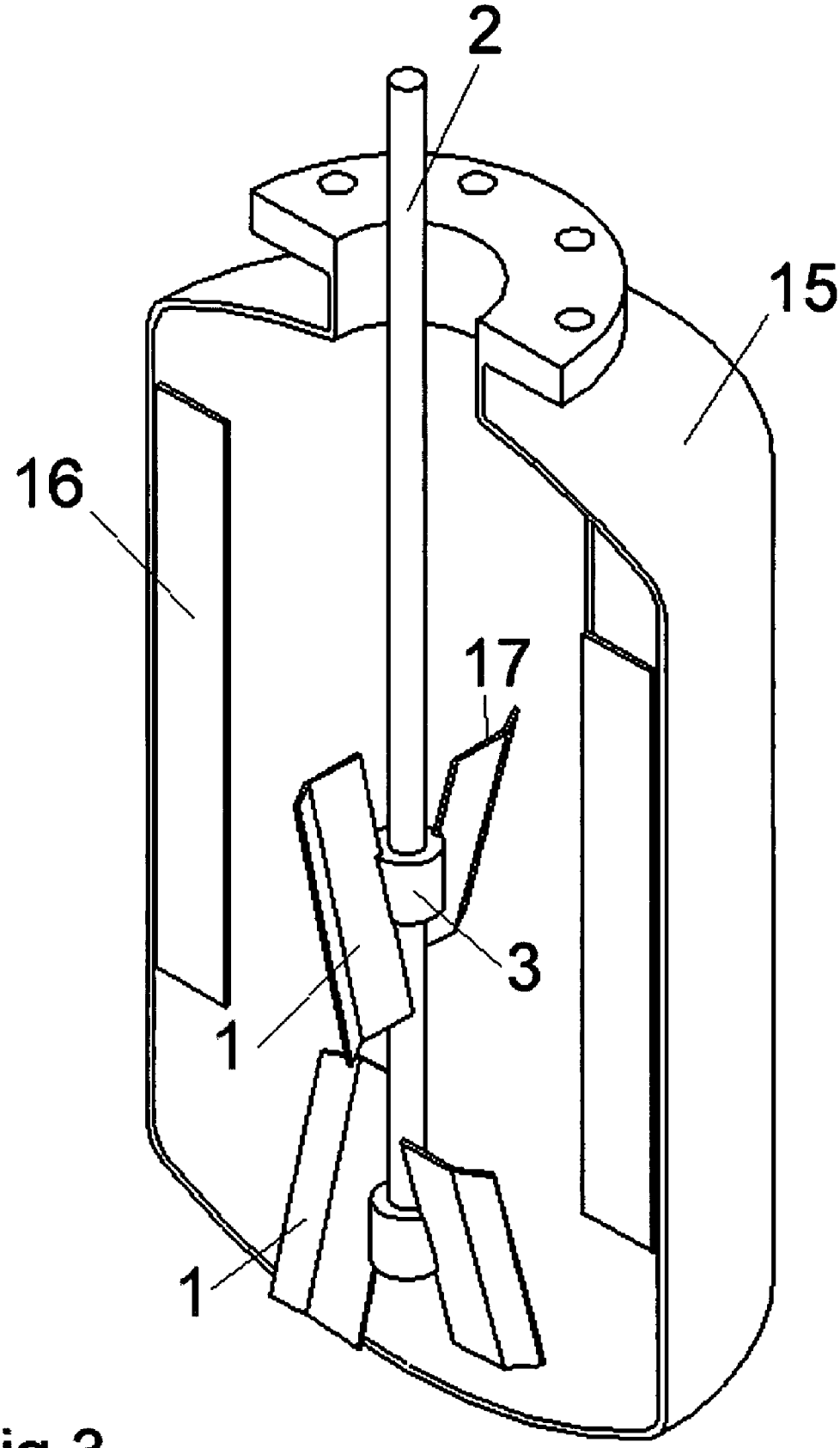
FIG. 3 is a perspective view, partly in section, showing a symmetrical impeller arrangement according to the invention in a mixing vessel with baffles.
Figure 4:
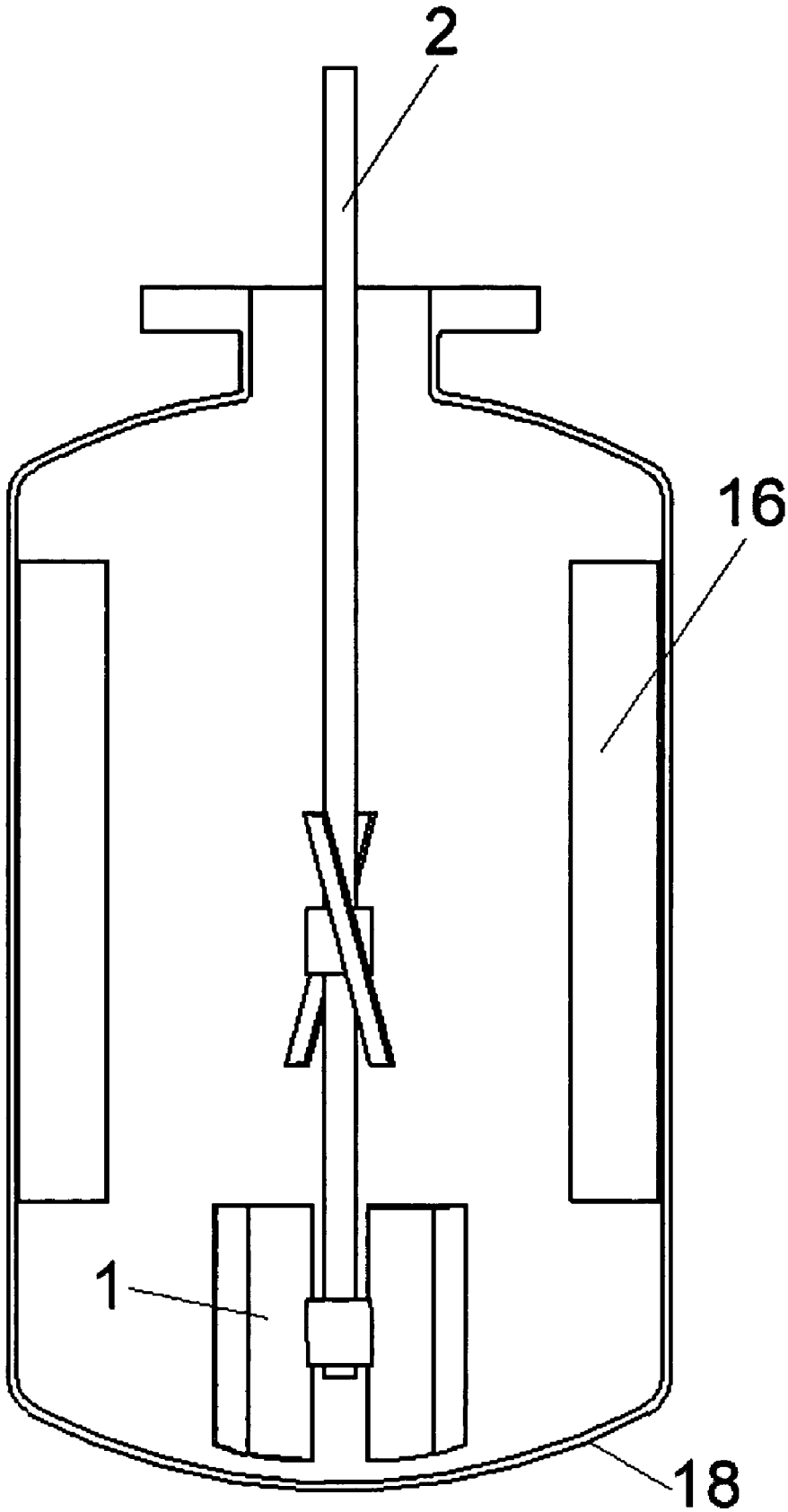
FIG. 4 is an elevation view, partly in section, showing application of the invention to a contoured impeller.
Figure 5:
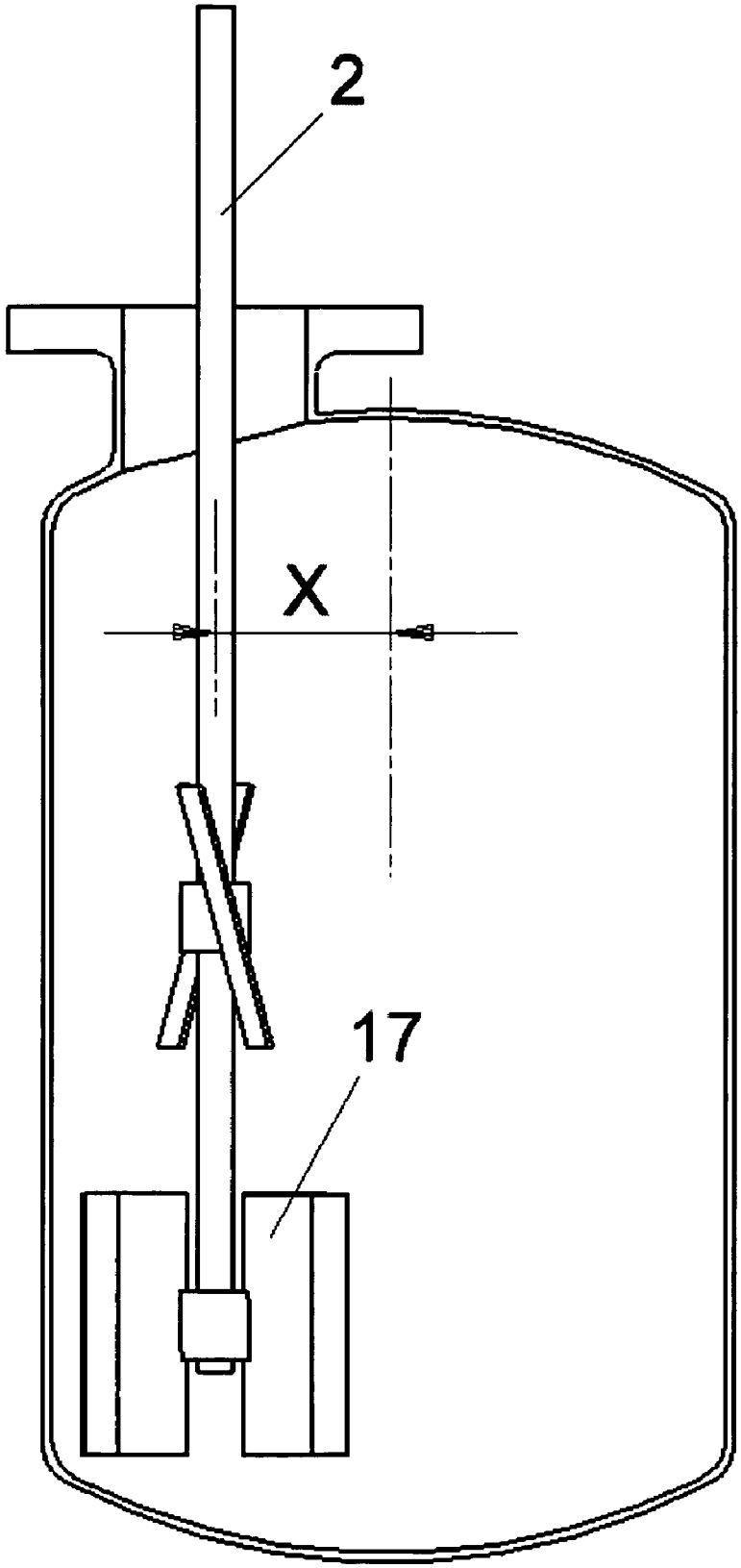
FIG. 5 is an elevation view, partly in section, showing symmetrical impellers mounted on a rotation axis that is off center relative to the vessel.

As shown in FIGS. 3–7, a vessel 15 can comprise a nozzle (number 20 in FIG. 7) defining an opening for passage of shaft 2 as well as defining the path of insertion or removal of the impeller arrangement. The nozzle can be located along a centerline of the vessel as in FIGS. 3, 4 or 6, or located off center as in FIG. 5. Typically, an off-center mounting distance X as in FIG. 5 is approximately 20% of the vessel inside diameter.

Particularly in embodiments with a centrally mounted shaft 2 carrying impellers 17, the vessel can have one or more vertical baffles 16. A plurality of vertical baffles 17 can be provided, each comprising a plate or other structure extending axially and disposed radially inwardly from inside of the vessel wall. Normally, arrangements with off-center mounting of shaft 2 provide good mixing without the need for such baffles.

In FIG. 4, the lower Impeller blades 1 may be contoured to complement the bottom head of the vessel, such as the downward dome shape of vessel 18. In FIGS. 3 and 5 the lower edge of the impeller blades 1 is perpendicular to the shaft rotation axis.

Figure 6:
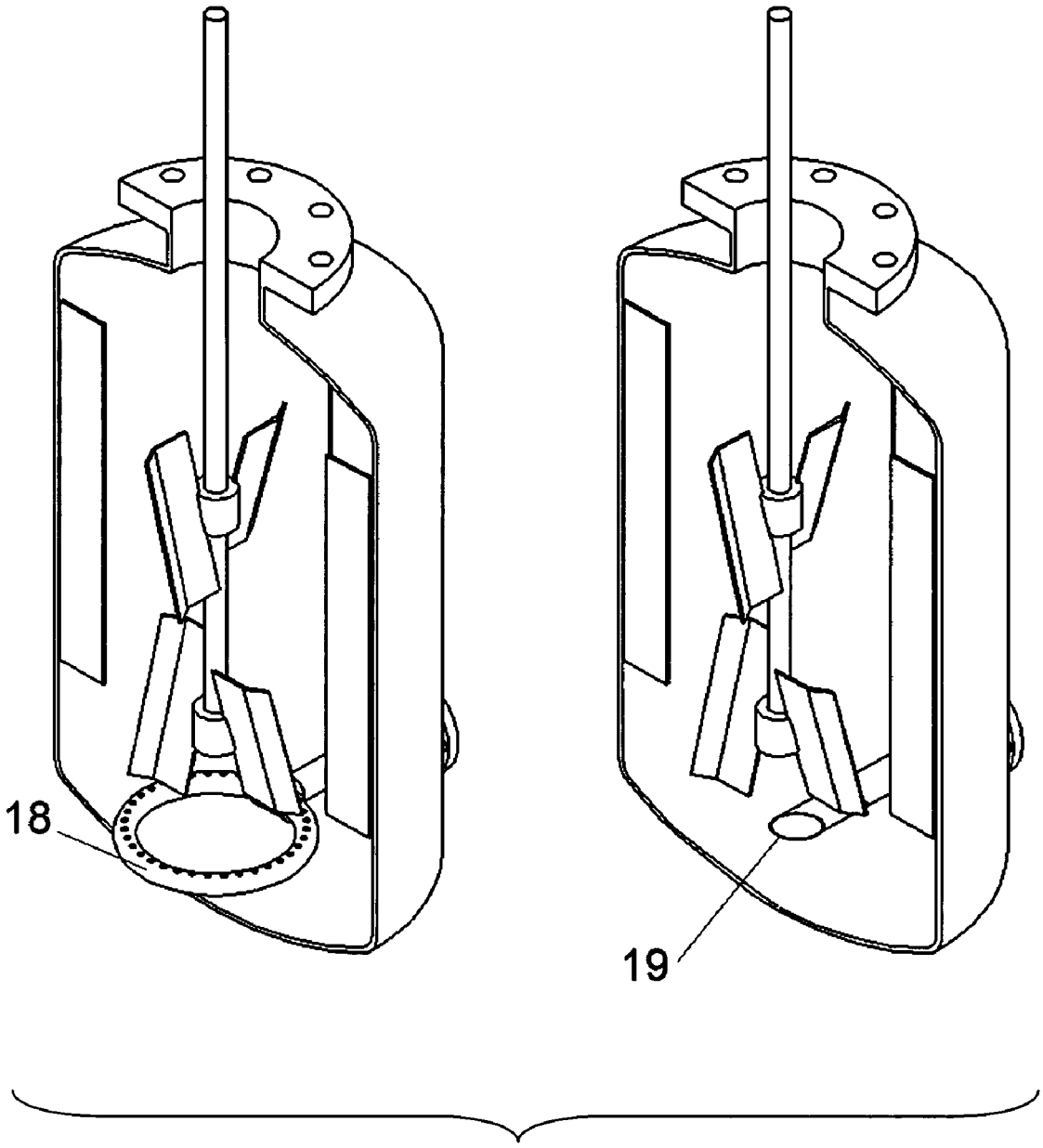
FIG. 6 is a sectional perspective comparison of symmetrical impeller arrangements used with gas sparging devices.

FIG. 6 shows an arrangement is which gas for dispersion into the product in the vessel can be delivered at the bottom of the vessel by a sparger 18 with an array of gas openings, or the sparging arrangement can simply comprise one or more pipes 19 at which the gas is delivered with sufficient pressure to be injected into the mix. Injected gas rises in the vessel. The sparger (or one or more pipe outlets) is located under the impeller. The impeller pumping direction may be up, together with the rising gas direction, or down in opposition thereto.

The invention having been disclosed and illustrated by examples, various modifications and variations can be seen as possible in light of the above teachings. It should be understood that the invention is not limited to the embodiments specifically used as examples, and reference should be made to the appended claims to assess the scope of the invention in which exclusive rights are claimed.

We claim:

1. An impeller for blending liquids and solids suspension materials, comprising:

at least two blades angularly distributed around a driving shaft rotatable on an axis, wherein the blades each comprise at least one flat plate, sloped to define an inclined plane relative to the axis for displacing the materials parallel to the axis;

wherein each blade has a bend at a position on a radial outside of a radially inner part of the blade that is flat, joining to a radially outer part of the blade that also is flat and is bent at a bend line in a direction outward of flow of said materials parallel to the axis; and, wherein the blades have an axial extension substantially equal to a diameter of a path of the blades in rotation about said axis.

2. The impeller of claim 1, wherein at least two of said blades are disposed at angular positions around a hub such that the blades are at equal axial positions on the driving shaft.

3. The impeller of claim 1, wherein at least two of said blades are diametrically opposite one another on a hub.

4. The impeller of claim 1, wherein said blades individually are placed angularly around the driving shaft so as to protrude radially at axially spaced positions, whereby the driving shaft, with the radially protruding axially space blades thereon, is insertable through an opening having a diameter less than the diameter of the path of the blades in rotation about said axis, by laterally displacing the shaft relative to the opening.

5. The impeller of claim 1, wherein the inclined plane is oriented at about 15° from a plane parallel to the rotation axis.

6. The impeller of claim 5, wherein the axis is vertical and the shaft has a rotation direction, and wherein the inclined plane is oriented to displace the materials downwardly.

7. The impeller of claim 5, wherein the axis is vertical and the shaft has a rotation direction, and wherein the inclined plane is oriented to displace the materials upwardly.

8. The impeller of claim 1, wherein the bend line is about 20° and is located at a radial distance from the rotation axis of about 70% of an outside diameter of the impeller path.

9. The impeller of claim 1, wherein at least one of the impeller blades is shaped to complement a vessel wall.

10. A mixing apparatus comprising:

a vessel for holding liquids and solids suspension materials to be blended;

an impeller comprising at least two blades angularly distributed around a driving shaft rotatable on an axis, wherein the blades each comprise at least one flat plate, sloped to define an inclined plane relative to the axis for displacing the materials parallel to the axis, wherein each blade has a bend at a position on a radial outside of a radially inner part of the blade that is flat, joining to a radially outer part of the blade that also is flat and is bent at a bend line in a direction outward of flow of said materials parallel to the axis, and, wherein the blades have an axial extension substantially equal to a diameter of a path of the blades in rotation about said axis.

11. The apparatus of claim 10, wherein the axis is substantially centered in the vessel and the vessel has at least one vertical baffle disposed adjacent to the path of the blades in rotation about said axis.

12. The apparatus of claim 11, wherein the vessel has a contoured wall and at least one of the blades passing near said contoured wall has a complementary contour therewith.

13. The apparatus of claim 10, wherein the axis is substantially off center relative to a center of the vessel.

14. The apparatus of claim 10, wherein the vessel has an opening for receiving the driving shaft and said blades individually are placed angularly around the driving shaft so as to protrude radially at axially spaced positions, wherein the opening is large enough to admit the shaft and one of said blades, and the opening is smaller than the diameter of the path of the blades in rotation about said axis.

15. A mixing apparatus, comprising:

a vessel for holding liquid and solid suspension materials;

an impeller comprising at least two blades angularly distributed around a driving shaft rotatable on an axis, wherein the blades each comprise at least one flat plate, sloped to define an inclined plane relative to the axis for displacing the materials parallel to the axis, wherein each blade has a bend at a position on a radial outside of a radially inner part of the blade that is flat, joining to a radially outer part of the blade that also is flat and is bent at a bend line in a direction outward of flow of said materials parallel to the axis, and, wherein the blades have an axial extension substantially equal to a diameter of a path of the blades in rotation about said axis;

wherein the inclined plane is oriented at about 15° from a plane parallel to the rotation axis, wherein the bend line forms an angle of about 20° with the plane parallel to the rotation axis and wherein the bend is located at a radial distance from the rotation axis of about 70% of an outside diameter of the impeller path.

16. The impeller of claim 15, wherein at least two of said blades are disposed at angular positions around a hub such that the blades are at equal axial positions on the driving shaft.

17. The impeller of claim 16, wherein at least two of said blades are diametrically opposite one another on a hub.

18. The impeller of claim 16, wherein said blades individually are placed angularly around the driving shaft so as to protrude radially at axially spaced positions.

19. The impeller of claim 16, wherein the vessel has an opening smaller than the diameter of the path of the blades and larger than a radial dimension of the driving shaft and one of said blades, such that the driving shaft with the blades thereon is insertable through the opening in the vessel.

* * * * *